US008863947B2

(12) United States Patent
Sibley

(10) Patent No.: US 8,863,947 B2
(45) Date of Patent: Oct. 21, 2014

(54) STORAGE PRESERVATION AND TRANSPORT FOR A CONTROLLED SUBSTANCE

(75) Inventor: David P. Sibley, Twin Falls, ID (US)

(73) Assignee: N2 Packaging Systems, LLC, Kimberly, ID (US)

( * ) Notice: Subject to any disclaimer, the term of this patent is extended or adjusted under 35 U.S.C. 154(b) by 191 days.

(21) Appl. No.: 13/233,931

(22) Filed: Sep. 15, 2011

(65) Prior Publication Data

US 2012/0061263 A1 Mar. 15, 2012

Related U.S. Application Data

(60) Provisional application No. 61/383,006, filed on Sep. 15, 2010.

(51) Int. Cl.

| | |
|---|---|
| ***B65D 81/28*** | (2006.01) |
| ***B65D 85/10*** | (2006.01) |
| ***B65B 31/00*** | (2006.01) |
| ***B65D 17/00*** | (2006.01) |
| ***B65D 51/20*** | (2006.01) |
| ***B65D 81/26*** | (2006.01) |
| ***B65B 61/20*** | (2006.01) |
| ***B65D 81/20*** | (2006.01) |
| *B65B 29/00* | (2006.01) |

(52) U.S. Cl.

CPC ..... *B65B 61/20* (2013.01); *B65D 17/163* (2013.01); *B65D 2517/0041* (2013.01); *B65D 2251/0071* (2013.01); *B65D 2251/0015* (2013.01); *B65D 51/20* (2013.01); *B65D 81/266* (2013.01); *B65B 29/00* (2013.01); *B65D 2203/12* (2013.01); *B65D 81/2069* (2013.01); *B65D 2203/10* (2013.01)

USPC ..... 206/213.1; 206/265; 206/459.5; 206/524.8; 53/408; 53/432

(58) Field of Classification Search

USPC ..... 206/213.1, 232, 242, 459.5, 524.8, 265; 53/403, 408, 467, 471, 473, 476, 432; 220/62.11–62.13

See application file for complete search history.

(56) References Cited

U.S. PATENT DOCUMENTS

| | | | | |
|---|---|---|---|---|
| 1,381,831 | A * | 6/1921 | Heeren | 206/264 |
| 4,883,198 | A * | 11/1989 | Manska | 220/231 |
| 5,443,174 | A * | 8/1995 | Bauer | 220/212 |
| 6,596,328 | B1 * | 7/2003 | Bezek et al. | 426/115 |
| 7,040,487 | B2 * | 5/2006 | Zabka et al. | 206/710 |
| 7,093,710 | B2 * | 8/2006 | Shimizu et al. | 206/213.1 |
| 2002/0169635 | A1 * | 11/2002 | Shillingburg | 705/2 |
| 2005/0173272 | A1 * | 8/2005 | Lemmons | 206/256 |

(Continued)

*Primary Examiner* — Luan K Bui

(74) *Attorney, Agent, or Firm* — Richard D. Clarke

(57) ABSTRACT

The present application provides a unique process of canning a controlled substance where the cans are hermetically sealed and clearly identified in a number of different ways. The process will begin by inserting a packing and dehumidifying agent, preferably a formed rice cake. The controlled substance is then inserted. In some cases the rice cakes will be eliminated or just a single rice cake will be used on the top or the bottom. If the process of storing the controlled substance in an inert atmosphere is desired, the oxygen in the container is replaced with gaseous nitrogen. After the container has been sealed in the conventional pop-top canning procedure; an identifying scent substance is permanently adhered to the can or label. An internal or external microchip could be used to detect, track and trace the container filled with a controlled substance.

20 Claims, 5 Drawing Sheets

(56) References Cited

U.S. PATENT DOCUMENTS

2008/0052044 A1* 2/2008 Shoenfeld ..... 229/300
2009/0212004 A1* 8/2009 Metzger et al. ..... 215/382
2009/0266736 A1* 10/2009 Sprishen et al. ..... 206/459.5
2010/0101186 A1* 4/2010 Cronin et al. ..... 53/436
2011/0174639 A1* 7/2011 Sibley ..... 206/3

* cited by examiner

STORAGE PRESERVATION AND TRANSPORT FOR A CONTROLLED SUBSTANCE

This application claims benefit of the provisional application No. 61/383,006, filed on Sep. 15, 2010.

FIELD OF THE INVENTION

This application provides a unique container for storing and transporting a controlled substance and a canning process for controlled substances where the cans are hermetically sealed and the contents are clearly identified in a number of different ways. In particular, the controlled substance containers are optimized for long term storage and can be readily detected, tracked and traced when filled with a controlled substance.

The transport and sales of controlled substances has generally in the past been handled through pharmaceutical suppliers but with several states looking at the legalized sales of products like Marijuana there is a great need to control, track and document these sales. Containers carrying controlled substances should be readily identifiable both by sight and odor. Dogs are often used to locate these items, but if they are sealed where the air and moisture in the container is replaced with an inert gas along with as dehumidifying agents before sealing, dogs might not be able to locate these items. Identifying odor materials can be attached directly to the outside of the container or to the label. There are other various was to identify these containers like colorization of the containers and their labels, bar coding and microchips either on the inside or affixed to the outside. Problems will definitely arise from the transport of these materials from a state that legalizes it to a state where its possession is still illegal. Clearly identifying these containers will help to alleviate some of these problems. If states that legalize the sales of controlled substances like Marijuana would stipulate that it is only to be sold in an identifiable sealed container, there could be a greater control of its propagation, sales and the state taxes paid. With the legalization and controlled sales, the price would come down so that it would not be profitable for the illegal growing of the products.

Numerous innovations for pharmaceutical products have been provided in the prior art that are described as follows. Even though these innovations may be suitable for the specific individual purposes to which they address, they differ from the present design as hereinafter contrasted. The following is a summary of those prior art patents most relevant to this application at hand; as well as a description outlining the difference between the features of the canning process of controlled substances and the prior art.

U.S. Pat. No. 5,135,144 of David C. Blakley describes a belt worn and readily portable medical supply pouch for holding a supply of drug containers in a temperature stable and contamination resistant environment is disclosed. A substantially rectangular housing fabricated from a thick insulating material comprising a bottom, two side panels, a front and a back panel with an open top. A housing thus formed defines a cavity therein for storing a supply of drug cartridges. A protective panel extending across the opening of the housing and angled downward into the cavity is provided to prevent contamination from entering the cavity, while providing access by the hand of a user through the opening and down into the cavity for retrieving one of the drug containers. The housing is covered inside and out by a water-proof and contamination-resistant nylon material. Two belt loop members are affixed to the back panel of the housing for attaching the pouch to the waist belt of a user. An internal pocket inside the cavity of the housing is provided for containing a heating element for heating the interior cavity. An outside auxiliary pocket is attached to the outside surface of the front panel for storing items not requiring an insulated and contamination free environment.

This patent describes a belt worn and readily portable medical supply pouch for holding a supply of drug containers. It does not describe a single sealed container for a controlled substance like Marijuana.

U.S. Pat. No. 5,836,474 Georan Wessberg tells of an invention that relates to a medicament storage device which includes a storage plate having a plurality of storage spaces for storing quantities, such as medicament dosages and a base unit which has a memory and an alarm function. The device is characterized in that the openings of respective storage spaces are provided with a closure means in the form of a long and a short flap which overlap one another and which are either spring mounted or consist of elastic material. The flap overlap regions include indicating means which illustrate in which direction passage has occurred through the opening and/or with detecting means which produce a signal relating to the direction of the last passage through the opening.

This patent tells of an invention that relates to a medicament storage device which includes a storage plate having a plurality of storage spaces for storing quantities, such as medicament dosages. It again does not describe a single sealed container for a controlled substance like Marijuana.

U.S. Pat. No. 5,866,219 of Paul McClure et al. relates to a product information label system having a base member and a foldout medical information pamphlet which is applied to medicinal and drug containers where the foldout pamphlet is resealable for subsequent use.

This patent relates to a product information label system and does not deal with any form of containment means.

U.S. Pat. No. 6,793,081 Jay S. Derman describes a locking neck ring device that is placed over a capped bottle or container and grips the bottle neck ring, and together with a padlock or other securing means, prevents access to the bottle cap. The locking device comprises a clamp member that jackets a capped bottle neck; a cover which fits over the clamp member causing it to clamp on to the neck below the neck ring, and means to hold the clamp member to the cover. Provision is made for attaching a padlock or other securing means which holds the locking ring device in place. The bottle or container cap can then not be accessed for removal. The device is applicable to all sizes of drug containers, wine and liquor bottles for effectively locking access to the container contents.

This patent describes a locking neck ring device that is placed over a capped bottle or container and grips the bottle neck ring. It does not with any specific containment means.

None of these previous efforts, however, provides the benefits attendant with the process of canning a controlled substance and do not mention the use of an inert gas, as a means of providing long-term storage. The present process of canning a controlled substance achieves its intended purposes, objects and advantages over the prior art through a new, useful and unobvious combination of method steps and component elements at a reasonable cost and by employing readily available materials.

In this respect, before explaining at least one embodiment of the canning a controlled substance in detail it is to be understood that the process is not limited to just a specific process set forth in the following description or illustrated in the drawings. The canning process of controlled substances is capable of having other embodiments and of being applied in various ways. In addition, it is to be understood that the phraseology and terminology employed herein are for the purpose of description and should not be regarded as limiting. As such, those skilled in the art will appreciate that the conception, upon which this disclosure is based, may readily be utilized as a basis for creating other processes for carrying out the several purposes of the present application. It is important, therefore, that the claims be regarded as including such equivalent construction insofar as they do not depart from the spirit and scope of the present application.

SUMMARY OF THE INVENTION

The principal advantage of the process of canning a controlled substance is to control the sales of the products.

Another advantage of the process of canning controlled substances is the control of the propagation of the products.

Another advantage of the process of canning controlled substances is to receive the sales tax for the products sold.

Another advantage of the process of canning controlled substances is the option of the removal of the oxygen and moisture while keeping the substance stored in an inert gaseous atmosphere.

Another advantage of the process of canning controlled substances is that with an external odor substance, dogs will be able to locate it.

Another advantage of the canning of controlled substances is that they can have a micro-chip on the inside or outside for product locating.

Another advantage of the canning of controlled substances is that they can have a bar code on the outside for product identification.

Another advantage in the process of the canning of controlled substances is that a variety of different packing and dehumidifying materials can be used, including formed rice cakes.

Another advantage is when formed rice cakes are used as a packing and dehumidifying agent, they can be easily disposed of.

Another advantage in the process of the canning of controlled substances is an inexpensive form container can be made in different sizes and shapes.

Yet another advantage in the process of canning a Controlled substance is it can use a variety of different inert gases in the manufacturing process if desired.

These together with other advantages in the process of canning a controlled substance, along with the various features of novelty, which characterize the process, are pointed out with particularity in the claims annexed to and forming a part of this disclosure. For a better understanding of the process of the canning of a controlled substance and its operating advantages and the specific objects attained by its uses, reference should be made to the accompanying drawings and descriptive matter in which there are illustrated preferred and alternate embodiments of the process of canning controlled substances. There has thus been outlined, rather broadly, the more important features of the process in order that the detailed description there of that follows may be better understood, and in order that the present contribution to the art may be better appreciated. There are additional features of the process of the canning of a controlled substance that will be described hereinafter and which will form the subject matter of the claims appended hereto.

The preferred embodiment of the process of the canning a controlled substance will be placing the controlled substance into the preformed metal container with an enameled surface on the inside and outside. The process will begin by inserting a packing and dehumidifying agent, preferably a formed rice cake. If a microchip is desired within the container it is put in before inserting the controlled substance. The controlled substance is then inserted with a second preformed rice cake on the top. In some cases the rice cakes will be eliminated or just a single rice cake will be used on the top or the bottom. All of the different configurations of containing the controlled substance with rice cakes will be covered within the scope of this application.

If the process of storing the controlled substance in an inert atmosphere is desired the container is placed into a vacuum chamber. The chamber doors are closed and a vacuum of approximately 29 inches of mercury is drawn on the chamber. This removes all of the atmosphere/oxygen and atmospheric moisture that may be present. The vacuum is then halted and the chamber is then flooded with gaseous nitrogen. The gas is inert and dry, creating a benign atmosphere inside the container and around the controlled substance. This dry, inert environment now created inside the container will halt the degradation of the controlled substance. The shelf life/storage time created by this process should give the controlled substance stored inside the container almost an unlimited life regardless of the environment outside the container. This application is not limited to gaseous nitrogen. Alternate methods can include liquid nitrogen, oxygen absorbers along with other inert gases such as carbon dioxide, helium, and argon. Any process used to create an inert/benign atmosphere while canning the controlled substances will be covered within the scope of this application.

After the evacuation/flooding process is complete the chamber doors are opened and the container, filled with nitrogen, is pushed out and immediately put through the conventional canning process. The nitrogen gas that is in the container at this time is very heavy, dense, and cold and is not naturally trying to diffuse into the air in the room allowing for a reasonable amount of time to apply a lid and seal the container. An alternate method of packaging would be to put the prepackaged controlled substance in a sealable plastic bag filled with nitrogen and place it within the container.

After the container has been sealed in the conventional pop-top canning procedure an identifying scent substance is permanently adhered to the can or label. If an external microchip is desired it can be adhered to the outside of the can or be incorporated into a plastic removable locking ring around the top of the can. The label can also have an identifying bar code imprinted on it or the bar code can be printed on the can.

An alternate embodiment of the of the process of canning a controlled substance would be the use of a polymer round pail type of container having a lid that screws on with a ratcheting locking mechanism and an O-ring seal. Once the polymer round pail has been filled, a cushioning and dehumidifying element such as a formed rice cake is placed on top of the substance. If the process of storing the controlled substance in an inert atmosphere is desired it is then placed into a vacuum chamber. The chamber doors are closed and a vacuum of approximately 29 inches of mercury is drawn on the chamber removing all of the atmosphere/oxygen and atmospheric moisture that may be present. The vacuum is then halted and the chamber is then flooded with gaseous nitrogen. The gas is inert and dry, creating a benign atmosphere inside the container and around the product. This dry, inert environment now created inside the container will halt degradation of the controlled substance. This application is not limited to gaseous nitrogen. Alternate methods can include liquid nitrogen, oxygen absorbers along with other inert gases such as carbon dioxide, helium, and argon. Any process used to create an inert/benign atmosphere inside the container will be covered within the scope of this application. Additional sealing will include a foil membrane attached over the top edge of the container with an O-ring in the lid making the final sealing means.

With respect to the above description then, it is to be realized that the optimum dimensional relationships for the parts of this application, to include variations in size, materials, shape, form, function and manner of operation, assembly and use, are deemed readily apparent and obvious to one skilled in the art. All equivalent relationships to those illustrated in the drawings and described in the specification intend to be encompassed by the present disclosure. Therefore, the foregoing is considered as illustrative only of the principles of the process of the canning of controlled substances. Further, since numerous modifications and changes will readily occur to those skilled in the art, it is not desired to limit the design to the exact construction and operation shown and described, and accordingly, all suitable modifications and equivalents may be resorted to, falling within the scope of this application.

BRIEF DESCRIPTION OF THE DRAWINGS

The accompanying drawings, which are incorporated in and form a part of this specification, illustrate embodiments of the process of canning a controlled substance and together with the description, serve to explain the principles of this application

For a fuller understanding of the nature and advantages of the process of canning a controlled substance, reference should be had to the following detailed description taken in conjunction with the accompanying drawings which are incorporated in and form a part of this specification, illustrate embodiments of the process together with the description, serve to explain the principles of this application.

DETAILED DESCRIPTION OF THE PREFERRED EMBODIMENTS

Figure 1:
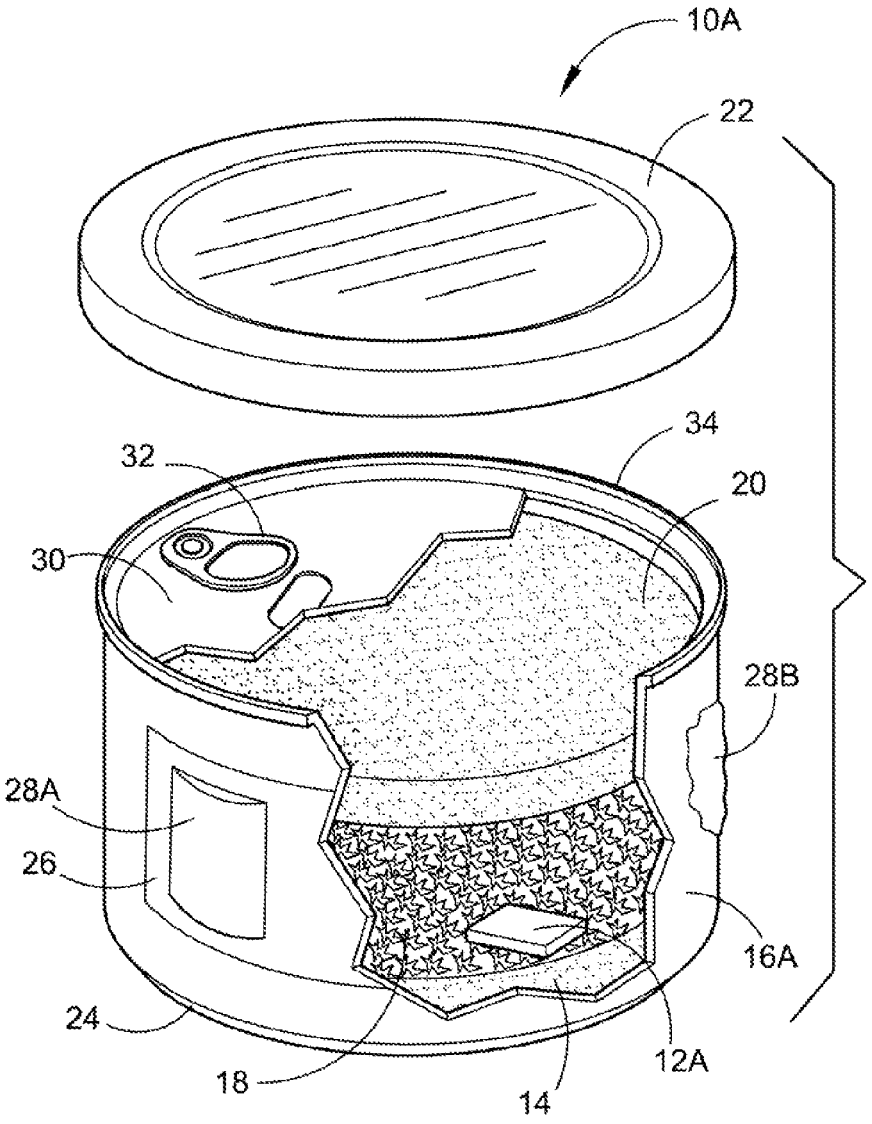
FIG. 1 depicts a perspective view of a pop-top can configured to contain a controlled substance and enable identification of the internal contents of such container, cut away illustrating a microchip on the preformed rice cake on the bottom of the can with the controlled substance between a second preformed rice cake with the plastic lid raised above.

Referring now to the drawings, wherein similar parts of the process of canning a controlled substance is illustrated there is seen in FIG. 1 a perspective view of a conventional pop-top can assembly 10A cut away illustrating the internal microchip 12A on the lower preformed rice cake 14 at the bottom of the container 16A. The controlled substance 18 is between the upper preformed rice cake 20 and lower preformed rice cake 14 with the plastic lid 22 above the container 16A. The container 16A will consist of a conventional pressed formed metal can without a crimped edge on the container bottom edge 24. The container 16A will have a label 26 where an external odor substance 28A can be located, or the external odor substance 28B can be adhered to the outside surface of the container 16A. The process of storing the controlled substance in an inert atmosphere is optional at this time. The conventional pop-top lid 30 with the opening tab 32 will be sealed to the container top edge 34 of the container 16A.

Figure 2:
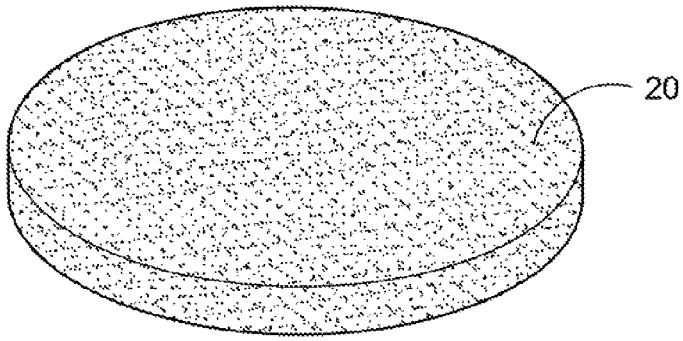
FIG. 2 depicts a perspective view of a preformed rice cake.

FIG. 2 depicts a perspective view of a preformed rice cake 14, 20.

Figure 3:
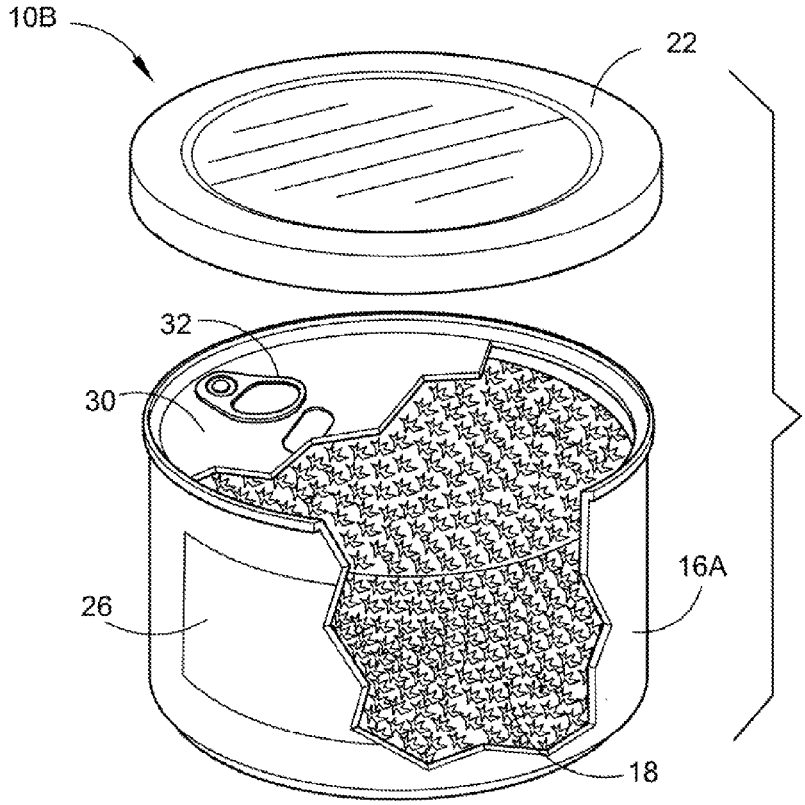
FIG. 3 depicts a perspective view of a pop-top can configured to contain a controlled substance and enable identification of the internal contents of such container, cut away illustrating the container completely filled with the controlled substance with the plastic lid raised above.

FIG. 3 depicts a perspective view of a pop-top can 10B configured to contain a controlled substance and enable identification of the internal contents of such container, cut away illustrating the container completely tilled with the controlled substance 18 with the plastic lid 22 above container 16A.

Figure 4:
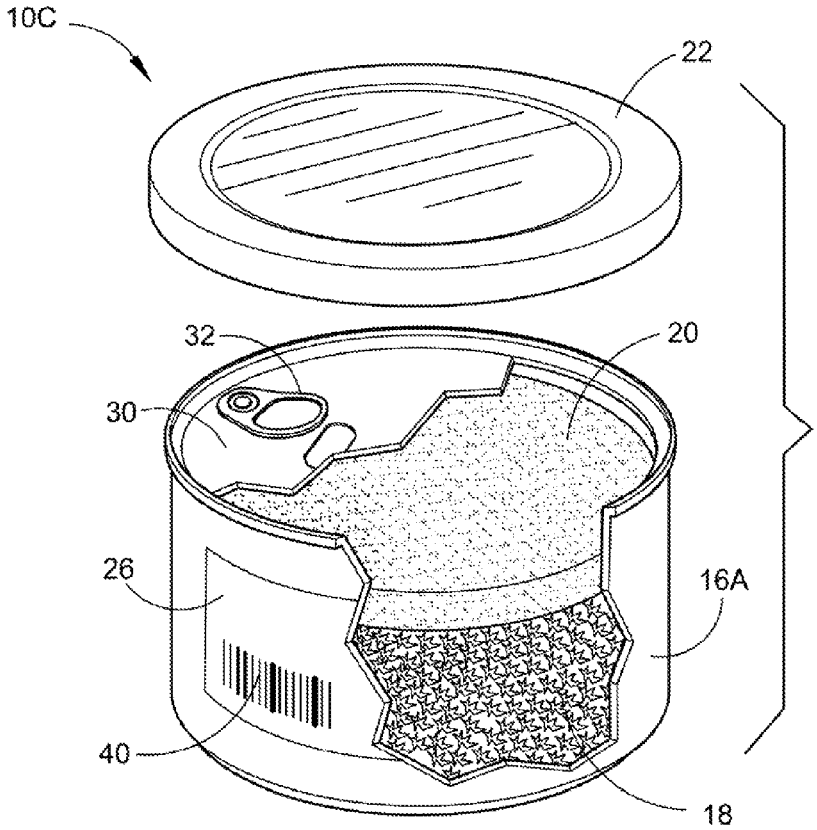
FIG. 4 depicts a perspective view of pop-top can configured to contain a controlled substance and enable identification of the internal contents of such container. cut away illustrating the controlled substance on the bottom of the container with a preformed rice cake on top with a barcode on the label and the plastic lid raised above.

FIG. 4 depicts a perspective view of a pop-top can 10C configured to contain a controlled substance and enable identification of the internal contents of such container, cut away illustrating the controlled substance 18 on the bottom of the container 16A with the upper preformed rice cake 20 with a barcode 40 on the label 26 and the plastic lid 22 above the container 16A.

Figure 5:
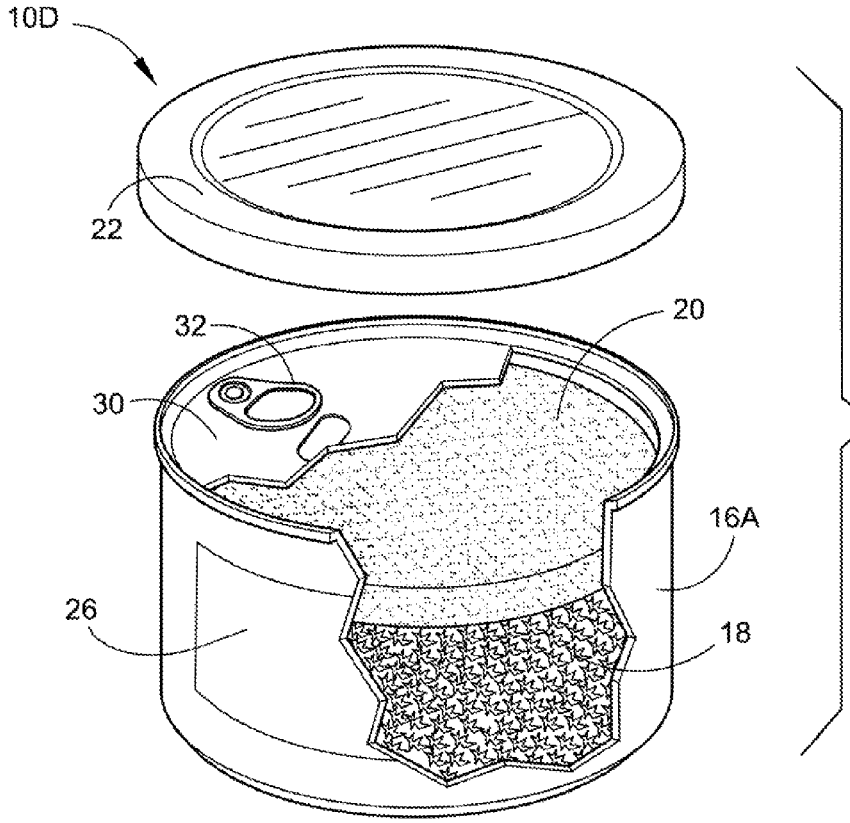
FIG. 5 depicts a perspective view of a pop-top can configured to contain a controlled substance and enable identification of the internal contents of such container, cut away illustrating the controlled substance on the bottom of the container with a preformed rice cake on top and the plastic lid raised above.

FIG. 5 depicts a perspective view of a pop-top can 10D configured to contain a controlled substance and enable identification of the internal contents of such container, cut away illustrating the controlled substance 18 on the bottom of the container 16A with the upper preformed rice cake 20 on top and the plastic lid 22 above the container 16A.

Figure 6:
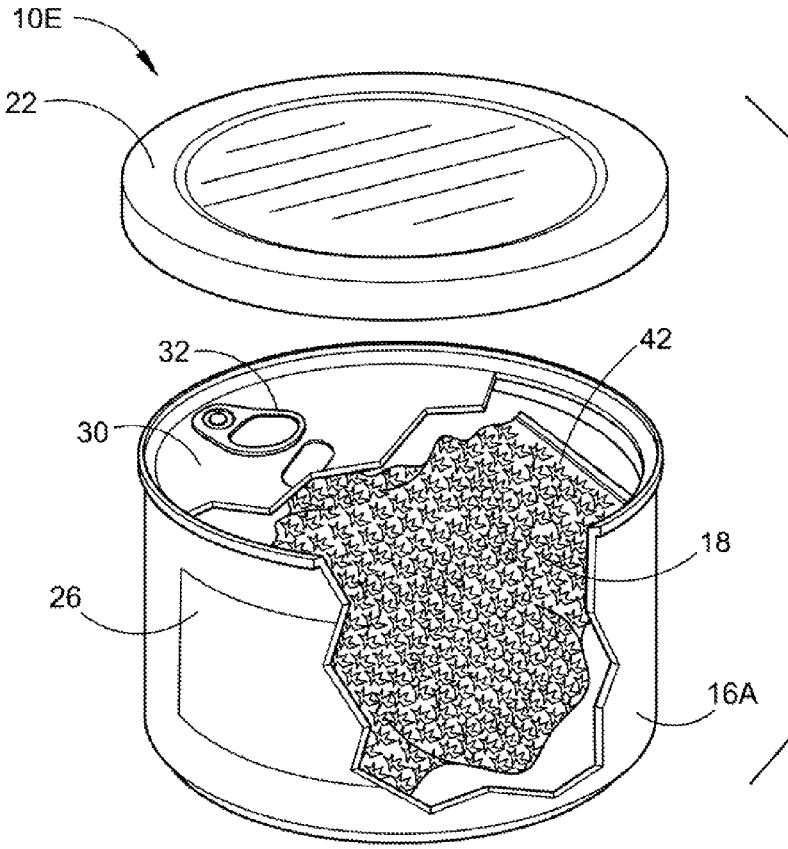
FIG. 6 depicts a perspective view of a pop-top sealed can configured to contain a controlled substance and enable identification of the internal contents of such container, with the controlled substance in a sealed plastic ban.

FIG. 6 depicts a perspective view of a pop-top sealed can 10E configured to contain a. controlled substance and enable identification of the internal contents of such container, with the controlled substance 18 in a sealed plastic bag 42.

Figure 7:
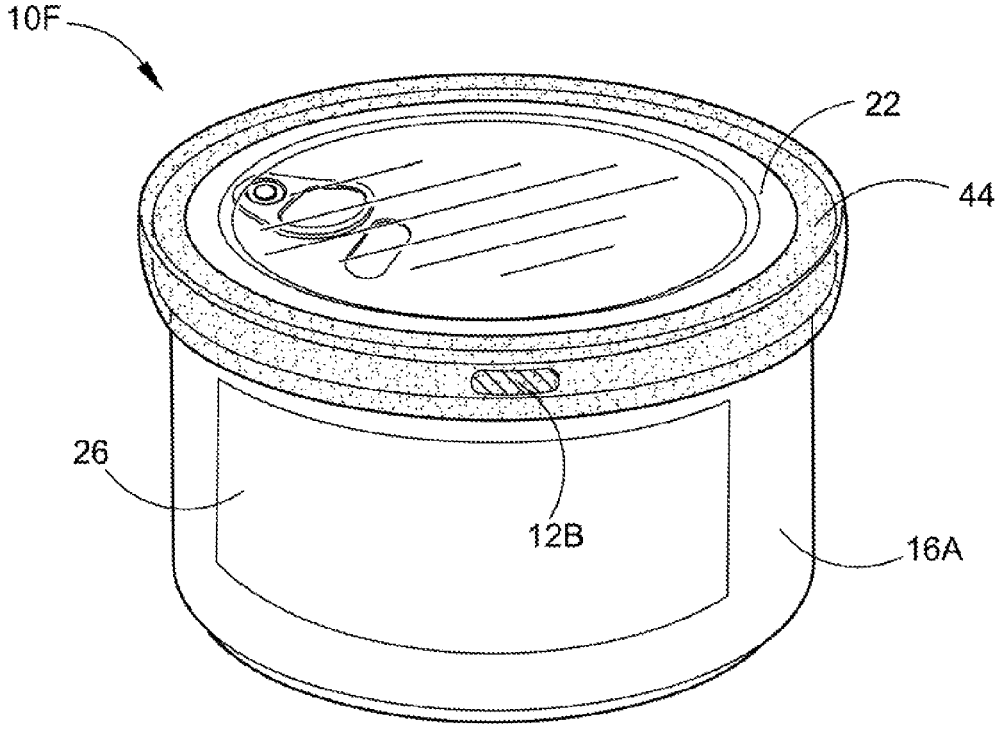
FIG. 7 depicts a perspective view of a pop-top sealed can configured to contain a controlled substance and enable identification of the internal contents of such container, with the plastic removable locking ring incorporating a microchip.

FIG. 7 depicts a perspective view of pop-top sealed can 10F configured to contain a controlled substance and enable identification of the internal contents of such container, with the plastic removable locking ring 44 over the plastic lid 22 and the top edge 34 of the container 16A incorporating the external microchip 12B.

Figure 8:
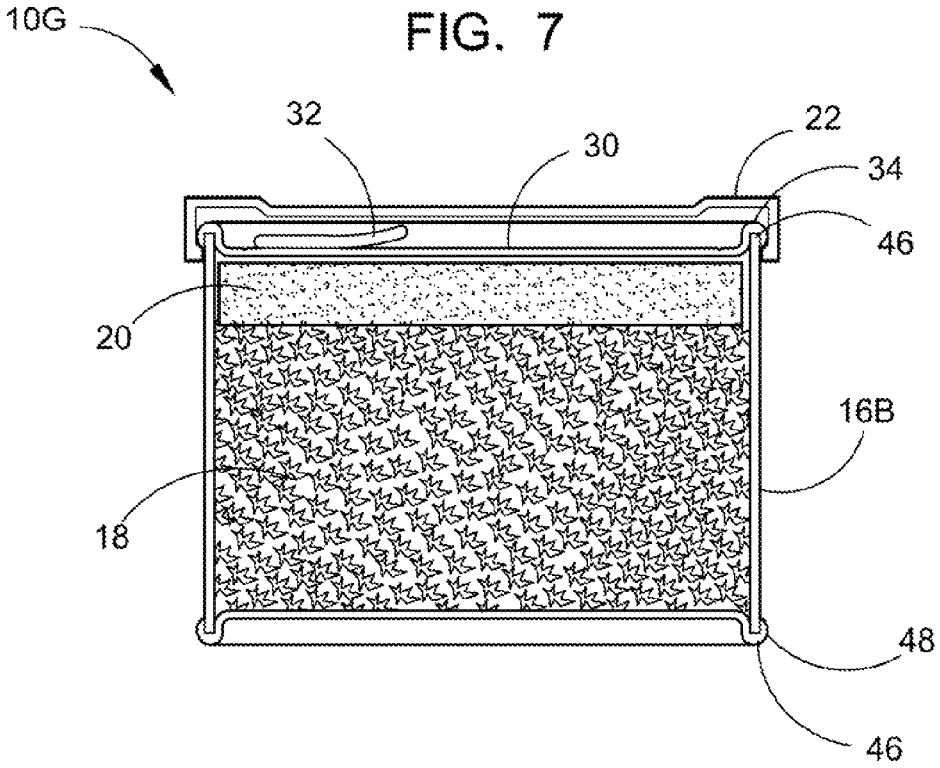
FIG. 8 depicts a cross section of pop-top can configured to contain a controlled substance and enable identification of the internal contents of such container, with a crimped edge on the bottom as well as the top. it should be understood that a conventional three-part tin (metal) can could be used, with or without a pop-top feature. This means that if a conventional three-part can is used without a pop-top feature, then it would necessitate a can opener be used to open the can to make the contents accessible.

FIG. 8 depicts a cross section of a three part pop-top can 10G configured to contain a controlled substance and enable identification of the internal contents of such container, with a crimped edge 46 on the container bottom edge 48 as well as the container top edge 34.

Figure 9:
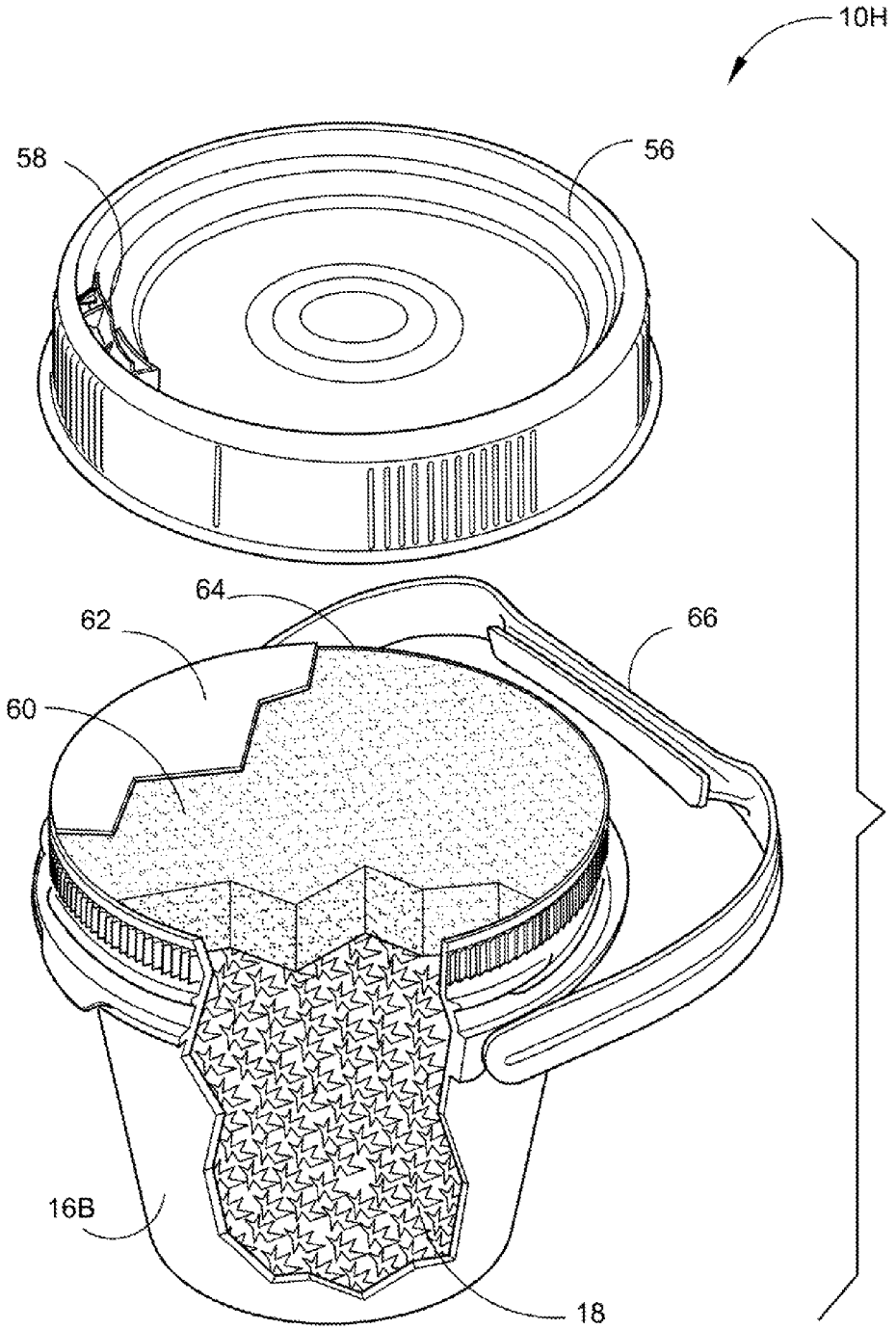
FIG. 9 depicts a perspective view of an alternate embodiment using a polymer round pail type of container having a lid that screws on with a ratcheting locking mechanism broken away illustrating the internal components.

FIG. 9 depicts a perspective view of an alternate embodiment 10H of the process of canning a controlled substance in bulk amounts using a polymer round pail type of container 16B having a lid 56 that screws on with a ratcheting locking mechanism 58. The polymer round pail 16B has been broken away illustrating the controlled substance 18 and the rice cake packing material 60. The process of storing the controlled substance in an inert atmosphere is optional at this time. A film seal 62 covers the top surface attached to the pail edge 64. The polymer round pail 16B has a pivoting handle 66. This polymer round pail container 16B would be used for bulk controlled substance storage and transport.

In summary, there are four basic configurations the controlled substance could be canned, (1) canned loosely alone with no spacer or insert; (2) canned with only a top spacer or insert; (3) canned with both a top and bottom spacer or insert, and (4) canned pre-packaged in a sealed plastic bag or foil envelope. Finally, bulk amounts of controlled substances could be stored and transported in large sealed polymer pails, with and without spacers or inserts.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

I claim:

1. A container for preservation, storage, tracking and transport of a controlled substance comprising:

(a) a one piece lower can portion containing a controlled substance;

(b) a one piece lid having a pop-top opening affixed to said lower can portion;

(c) a sealable plastic bag and an insert spacer means for taking up empty space left within said lower can portion; and (d) means for identifying the controlled substance held within said container;

wherein the controlled substance is placed in said sealable plastic bag and said sealable plastic bag is sealed before the container is sealed.

2. The container for preservation, storage, tracking and transport of a controlled substance according to claim 1, wherein said means for identifying the internal contents of said container includes a label affixed to the outer surface of said container.

3. The container for preservation, storage, tracking and transport of a controlled substance according to claim 1, wherein said means for identifying the internal contents of said container includes a bar code affixed to the outer surface of said container.

4. The container for preservation, storage, tracking and transport of a controlled substance according to claim 1, wherein said means for identifying the internal contents of said container includes a microchip affixed to the outer surface of said container.

5. The container for preservation, storage and transport of a controlled substance according to claim 1, wherein the container comprises a using a polymer round pail type of container having a lid.

6. The container for preservation, storage, tracking and transport of a controlled substance according to claim 1, wherein the controlled substance is held loosely within the container without the use of a spacer insert.

7. The container for preservation, storage, tracking and transport of a controlled substance according to claim 1, wherein said sealable plastic bag includes a sealable foil envelope.

8. The container for preservation, storage, tracking and transport of a controlled substance according to claim 1, wherein said insert spacer means includes a top spacer insert.

9. The container for preservation, storage, tracking and transport of a controlled substance according to claim 1, wherein said insert spacer means includes both a top spacer insert and a bottom spacer insert.

10. The container for preservation, storage, tracking and transport of a controlled substance according to claim 1. wherein said container has the atmosphere evacuated and the container filled with an inert gas before the controlled substance is sealed inside.

11. A method for making a container for preserving, storing, tracking and transporting a controlled substance, comprising the steps of:

(a) providing a one piece lower can portion for containing a controlled Substance;

(b) providing a one piece lid having a pop-top opening means thereon affixed to said lower can portion;

(c) providing a sealable plastic bag and an insert spacer means for taking up empty space left within said lower can portion;

(d) sealing a controlled substance within said lower can portion; and (e) providing a means for identifying the controlled substance held within said sealed container;

wherein the controlled substance is placed in said sealable plastic bag and said sealable plastic bag is sealed before the container is sealed.

12. The method for making a container for preservation, storage, tracking and transport of a controlled substance according to claim 11, wherein said means for identifying the internal contents of said container includes a label affixed to the outer surface of said container.

13. The method for making a container for preservation, storage, tracking and transport of a controlled substance according to claim 11, wherein said means for identifying the internal contents of said container includes a bar code affixed to the outer surface of said container.

14. The method for making, a container for preservation, storage, tracking and transport of a controlled substance according to claim 11, wherein said means for identifying the internal contents of said container includes a microchip affixed to the outer surface of said container.

15. The method for making a container for preservation, storage and transport of a controlled substance, according to claim 11, wherein the container comprises a using a polymer round pail type of container having a lid.

16. The method for making a container for preservation, storage, tracking and transport of a controlled substance according to claim 11, wherein the federally controlled substance is held loosely within the container without the use of a spacer insert.

17. The method for making a container for preservation, storage, tracking and transport of a controlled substance according to claim 11, wherein said sealable plastic bag includes a sealable foil envelope.

18. The method for making a container for preservation, storage, tracking and transport of a controlled substance according to claim 11, wherein said insert spacer means includes a top spacer insert.

19. The method for making a container for preservation, storage, tracking and transport of a controlled substance according to claim 11, wherein said insert spacer means includes both a top spacer insert and a bottom spacer insert.

20. The method for making a container for preservation, storage, tracking and transport of a controlled substance according to claim 11, wherein said container has the atmosphere evacuated and the container filled with an inert gas before the controlled substance is sealed inside.

* * * * *